United States Patent [19]

Labelle

[11] 4,380,260

[45] Apr. 19, 1983

[54] FOLDING CLOSURE WITH A SWEEPER

[76] Inventor: Henri M. R. Labelle, 50 Westmooreland Ave., Cornwall, Ont., Canada

[21] Appl. No.: 295,229

[22] Filed: Aug. 21, 1981

[51] Int. Cl.[3] ..... E06B 3/12

[52] U.S. Cl. ..... 160/235; 160/40; 160/183; 160/199; 160/206

[58] Field of Search ..... 160/40, 117, 183, 199, 160/206, 235; 49/489

[56] References Cited

U.S. PATENT DOCUMENTS

| | | | |
|---|---|---|---|
| 2,331,822 | 10/1943 | Zechiel et al. | 160/40 |
| 2,858,583 | 11/1958 | McEvoy et al. | 49/489 |
| 2,866,237 | 12/1958 | May | 49/489 |
| 3,082,817 | 3/1963 | Merrill | 160/40 |
| 3,359,594 | 12/1967 | Pastoor | 160/235 |
| 3,440,786 | 4/1969 | Weaver | 160/117 |
| 3,672,424 | 6/1972 | Brown | 160/40 |

*Primary Examiner*—Peter M. Caun
*Attorney, Agent, or Firm*—Jack Paavila

[57] ABSTRACT

An improved folding closure consisting of a plurality of panels joined at adjacent vertical sides by hinges. Means are provided on each panel for carrying a sweeper strip across the bottom of the closure. The carrying means include means for strengthening the bottom of each panel.

9 Claims, 5 Drawing Figures

FOLDING CLOSURE WITH A SWEEPER

BACKGROUND OF THE INVENTION

This invention is directed toward an improved folding closure.

The invention is more particularly directed toward a folding closure having a sweeper along its bottom edge.

The invention is also directed toward a strengthened folding closure.

It is well known to employ a sweeper on the bottom of a rigid closure to more completely close an opening. The sweeper normally comprises a flexible strip which extends over the width of the closure and projects down from its bottom edge to contact, or to lie closely adjacent to, the floor. Folding closures, which employ narrow panels connected at adjacent vertical sides by hinges, have not been able to employ sweepers however because of the difficulty in mounting the sweeper on the panels so that it folds and unfolds with the panels during operation of the closure. The sweeper is usually carried on a rigid closure by a carrier member mounted on one side or the other of the closure, adjacent its bottom edge. If such a carrier member is hinged and employed in a folding closure however, in being mounted on a side of the panels, it interfers with folding of the closure. In addition, a hinged carrier member is relatively expensive.

SUMMARY OF THE INVENTION

It is a purpose of the present invention to provide a folding closure with a sweeper, the installation of which does not interfere with the operation of the closure.

It is another purpose of the present invention to provide a folding closure with a sweeper installation which is relatively simple and inexpensive to construct and to install.

The present invention provides a novel means for use in mounting a sweeper on a folding closure without creating interference problems and without excessive expense. In accordance with the present invention, it has been discovered that a flexible sweeper can be easily mounted on the bottom edge of a folding closure by the use of carrier members mounted on the bottoms of the panels. One carrier member is mounted on the bottom of each panel between the hinges. The sweeper strip is then mounted to project down from the members, preferably from the center of the members, the strip passing from one member to the next adjacent member beneath the hinges in unsupported fashion. Since the carrier members are mounted beneath the panels, they do not interfere with folding of the closure. Since the sweeper strip spans the hinge areas in unsupported fashion, no hinges or other connections are required between adjacent carrier members.

It has also been found that the carrier members can be easily attached to the folding closure employing existing fasteners. This simplifies installation of the sweepers.

It has further been discovered that the carrier members can be used to strengthen the panels in the closure. The panels in a folding closure often employ a relatively thin bottom plate. The plate can be relatively easily bent or distorted. It has been found however that the carrier members can be easily modified to rigidly hold the plate by its bottom edge thereby stiffening it and making it harder to bend or distort the plate.

It is thus another purpose of the present invention to provide a folding closure with a sweeper which closure is strengthened as a result of the installation of the sweeper.

The invention is particularly directed toward a folding closure having a plurality of panels and hinges connecting the vertical sides of adjacent panels together. A carrier member extends across the bottom of each panel between the hinges. A sweeper strip is carried by the carrier members across the bottom of the closure, the strip extending between adjacent carrier members in unsupported fashion beneath the hinges.

The holding closure includes means on each carrier member for strengthening the bottom of each panel.

DESCRIPTION OF THE PREFERRED EMBODIMENT

Figure 1:
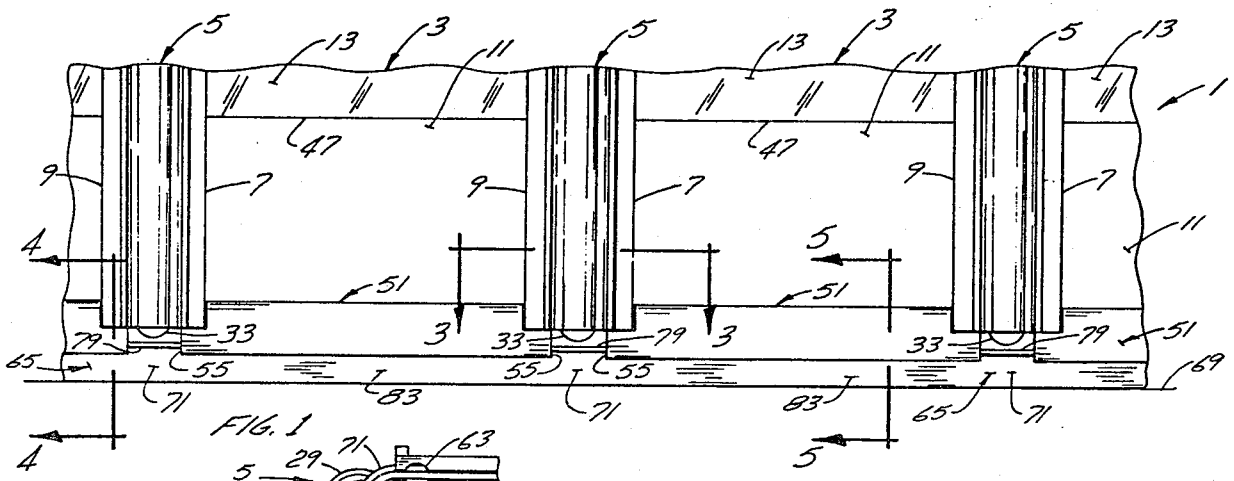
FIG. 1 is a partial elevation view of the bottom portion of a folding closure in the unfolded position.
Figure 2:
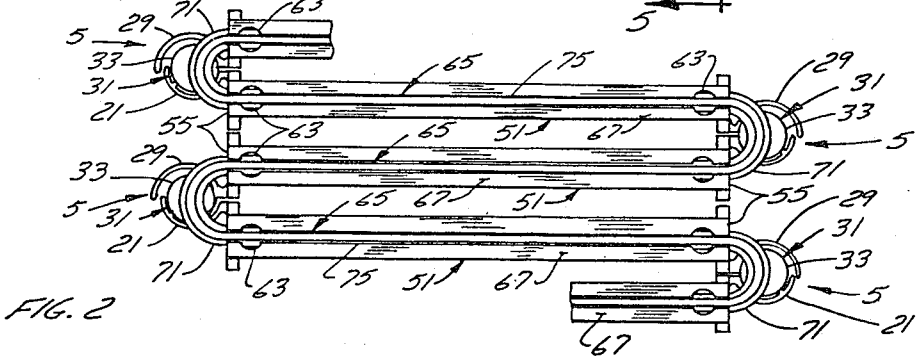
FIG. 2 is a partial bottom view of the closure in a folded position.

The folding closure 1 of the present invention, as shown in FIGS. 1 and 2 comprises a plurality of narrow panels 3 joined together at adjacent sides by hinges 5 so that the closure can fold up for storage or unfold to extend across an opening to close it. The closure 1 is normally suspended from a track by a plurality of trolleys running on the track. Each panel 3 can consist of two parallel, vertical side frames 7, 9 with a bottom plate 11 and a top plate (not shown) extending between the bottom and top ends respectively of the side frames 7, 9. A transparent pane 13 may be mounted between the bottom and top plates and the sides frames 7, 9.

Figure 3:
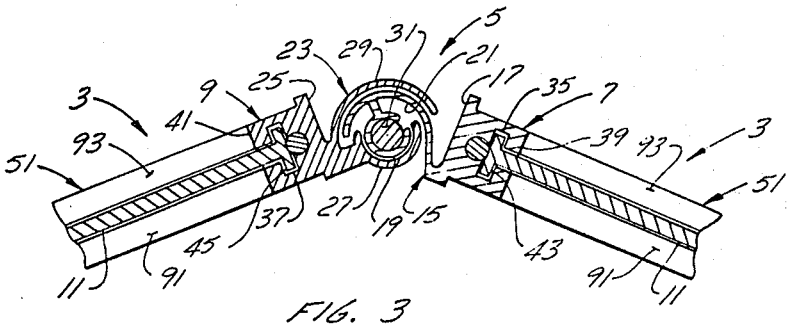
FIG. 3 is a cross-section view taken along line 3—3 in FIG. 1.

One of the side frames 7, as shown in FIG. 3, carries a male hinge member 15 projecting from the outer side 17 of the frame. The male hinge member 15 can comprise a central pintle 19 and a curved intermediate arm 21 concentric about the pintle 19. The other side frame 9 carries a female hinge member 23 projecting from the outer side 25 of the frame 9. The female hinge member 23 can comprise a curved inner arm 27 and an oppositely curved outer arm 29. When adjacent panels 3 are hingedly connected together, the male hinge member 15 slides into the female hinge member 23 to form hinge 5 with the pintle 19 being central in the hinge, arm 21 lying between arms 27 and 29, and all three arms being concentric about pintle 19. A connector, such as a self-tapping screw 31 is inserted upwardly into the pintle 19 of each hinge 5 from the bottom edge of the panels. The head 33 of screw is large enough to cover at least pintle 19 and inner arm 27 of hinge 5 and retains adjacent panels 4 aligned.

A central, longitudinal groove 35, 37 is provided in the inner side 39, 41 of each side frame 7, 9 respectively. Each groove 35, 37 preferably has a T-shaped cross-section. The bottom plate 11, as well as the top plate, has flanges 43, 45 along its side edges which flanges slide into grooves 35, 37 respectively to lock the side frames 7, 9 of each panel 3 together. The transparent pane 13 is made wide enough as well to enter both grooves 35, 37 and sits on the top edge 47 of bottom plate 11. The bottom plate 11 is retained between the side frames 7, 9 by suitable fastening means as will be described.

Figure 4:
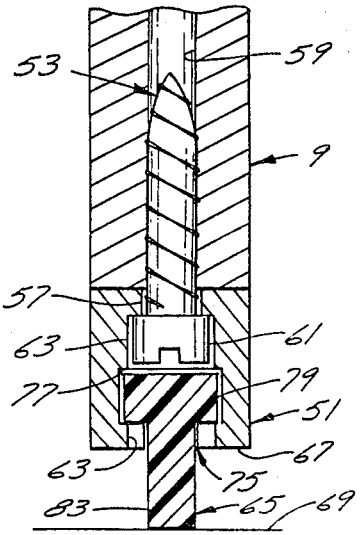
FIG. 4 is a cross-section view taken along line 4—4 of FIG. 1.
Figure 5:
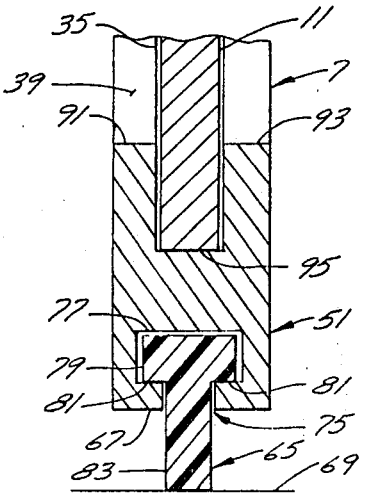
FIG. 5 is a cross-section view taken along line 5—5 of FIG. 1.

In accordance with the present invention a carrier member 51 is provided at the bottom of each panel 3 extending between the hinges 5 as shown in FIGS. 1 and 2. Each carrier member 51 is fastened by suitable means to the panel 3. The fastening means preferably comprises a self-tapping screw 53 adjacent each end 55 of the carrier 51 which passes upwardly through a hole 57, as shown in FIG. 4, in the carrier and into a central hole 59 in each frame 7, 9. The screws 53 are recessed within the carrier 51 with the screw heads 61 lying within a counterbore 63 of mounting hole 57. The screws 53 fasten the carrier 51 tight against the bottom of the panel 3, the carrier 51 retaining the bottom plate 11 within the side frames 7, 9.

A flexible sweeper 65 is fastened to the bottom of the panels 3. The sweeper 65 extends over the length of the closure 1 and may be made in one or several sections. The sweeper 65 is attached by suitable means to the carriers 51 and projects below the bottom surface 67 of the carriers 51 to rest on, or closely adjacent to, the floor 69. The sweeper 65 passes from one carrier to the next, having an unsupported section 71 beneath each hinge 5. The means for fastening the sweeper 65 to the carriers 51 includes a central, longitudinal slot 75 in the bottom surface 67 of each carrier 51 extending between its ends 55. The slot 75 has a T-shaped cross-section with the base 77 of the slot 75 lying just below the heads 61 of the fastening screws 53. The sweeper 65 is provided with a flange 79 on its upper edge. The flange 79 lies within slot base 77 resting on the shoulders 81 of the slot 75 with the main body 83 of the sweeper 65 hanging down from flange 79 and extending out of slot 75 below the bottom surface 67 of the carriers.

The sweeper 65 extends over the length of the closure 1 when the closure is unfolded as shown in FIG. 1, passing from one carrier 51 to the next, and retained in position by cooperation of the flange 79 with shoulders 81 in slots 75. When the closure 1 is folded for storage, the sweeper 65 is free to fold at the unsupported sections 71 beneath hinges 5 as shown in FIG. 2.

The carriers 51 preferably are used to strengthen the closure 1 as well as to carry the sweeper 65. In accordance with the present invention, each carrier 51 is provided with means for stiffening the bottom plate 11 of each panel 3. The stiffening means preferably comprises a pair of parallel, spaced-apart longitudinal flanges 91, 93 extending up from the top surface 95 of the carrier 51. A slot is formed between flanges 91, 93, just wide enough to receive the bottom portion of bottom plate 11 with the bottom edge of plate 11 resting on surface 95. The flanges 91, 93 stiffen the lower portion of plate 11 making the closure 1 much stronger.

I claim:

1. A folding closure having a plurality of panels arranged one after the other; a hinge located between each pair of adjacent panels, the hinge joining the adjacent panels together along their adjacent side edges while spacing the adjacent panels slightly apart to provide a gap between them; a carrier member on, and extending across, the bottom of each panel; one or more sweeper strips slidably mounted on the carrier members to provide a sweeper extending across the bottom of the closure, each sweeper strip traversing at least several consecutive panels and passing unbroken and unsupported from one carrier member to the next across each gap between adjacent panels.

2. A folding closure as claimed in claim 1 including means on each carrier member for strengthening the bottom of each panel.

3. A folding closure as claimed in claim 1 wherein each panel has a bottom plate, a top plate and a pair of side frames, the bottom and top plates mounted between the side frames, and fastening means connecting the ends of the carrier member to the side frames to retain the bottom plate between the side frames.

4. A folding closure as claimed in claim 3 including a central longitudinal slot in the bottom surface of the carrier member, and cooperating means in the slot and on the sweeper strip for retaining the sweeper strip on the carrier member, extending down from the slot.

5. A folding closure as claimed in claim 4 wherein the slot is located below the fastening means connecting the carrier member to the side frames.

6. A folding closure as claimed in claim 4 including means on each carrier member for strengthening the bottom of each bottom plate.

7. A folding closure as claimed in claim 2 wherein the strengthening means comprise a pair of spaced-apart flanges extending up from the top surface of the carrier member to receive the bottom portion of the panel therebetween.

8. A folding closure as claimed in claim 6 wherein the strengthening means comprise a pair of spaced-apart flanges extending up from the top surface of the carrier member to receive the bottom portion of the bottom plate therebetween.

9. A folding closure as claimed in claim 1 including a central, longitudinal slot in the bottom surface of each carrier member, and cooperating means in the slot and on the sweeper strip for retaining the sweeper strip on each carrier member, extending down from the slot.

* * * * *